United States Patent [19]

Ricard

[11] 3,970,836

[45] July 20, 1976

[54] MOTOR VEHICLE HEADLAMPS

[75] Inventor: Jacques Ricard, Fontenay-sous-Bois, France

[73] Assignee: Cibie Projecteurs, Bobigny, France

[22] Filed: Dec. 10, 1974

[21] Appl. No.: 531,232

[30] Foreign Application Priority Data

Dec. 26, 1973 France ..... 73.46304

[52] U.S. Cl. ..... 240/41 R; 240/41.4 R; 240/106.1

[51] Int. Cl.[2] ..... F21M 3/00

[58] Field of Search ..... 240/41 R, 41.4 R, 106.1, 240/106, 41.3

[56] References Cited

UNITED STATES PATENTS

| | | | |
|---|---|---|---|
| 2,122,465 | 7/1938 | Graves | 240/41.4 R |
| 2,846,568 | 8/1958 | Falge | 240/41.4 R |
| 3,858,040 | 12/1974 | Ricard | 240/106.1 X |

FOREIGN PATENTS OR APPLICATIONS

| | | | |
|---|---|---|---|
| 62,794 | 7/1968 | Germany | 240/41.4 R |
| 1,110,583 | 7/1961 | Germany | 240/41.4 R |
| 571,845 | 1/1958 | Italy | 41.4 R/ |

*Primary Examiner*—R. L. Moses
*Attorney, Agent, or Firm*—Edward J. Brenner

[57] ABSTRACT

A motor vehicle headlamp with a front glass having first prismatic surfaces which raise the horizontal cut-out line of one half of the dipped beam on the side of the road on which the vehicle is travelling so that the cut-out line consists of two horizontal lines joined by an oblique line, the lower horizontal cut-out line being on the side along which traffic travels in the opposite direction. A second prismatic surface is provided on the headlamp glass alongside the first prismatic surfaces. This second prismatic surface constitutes a window which directs a beam of light above the upper cut-out line of the dipped beam to illuminate objects on the vehicle's side of travel above the level of upper cut-out line.

4 Claims, 5 Drawing Figures

Figure 5:
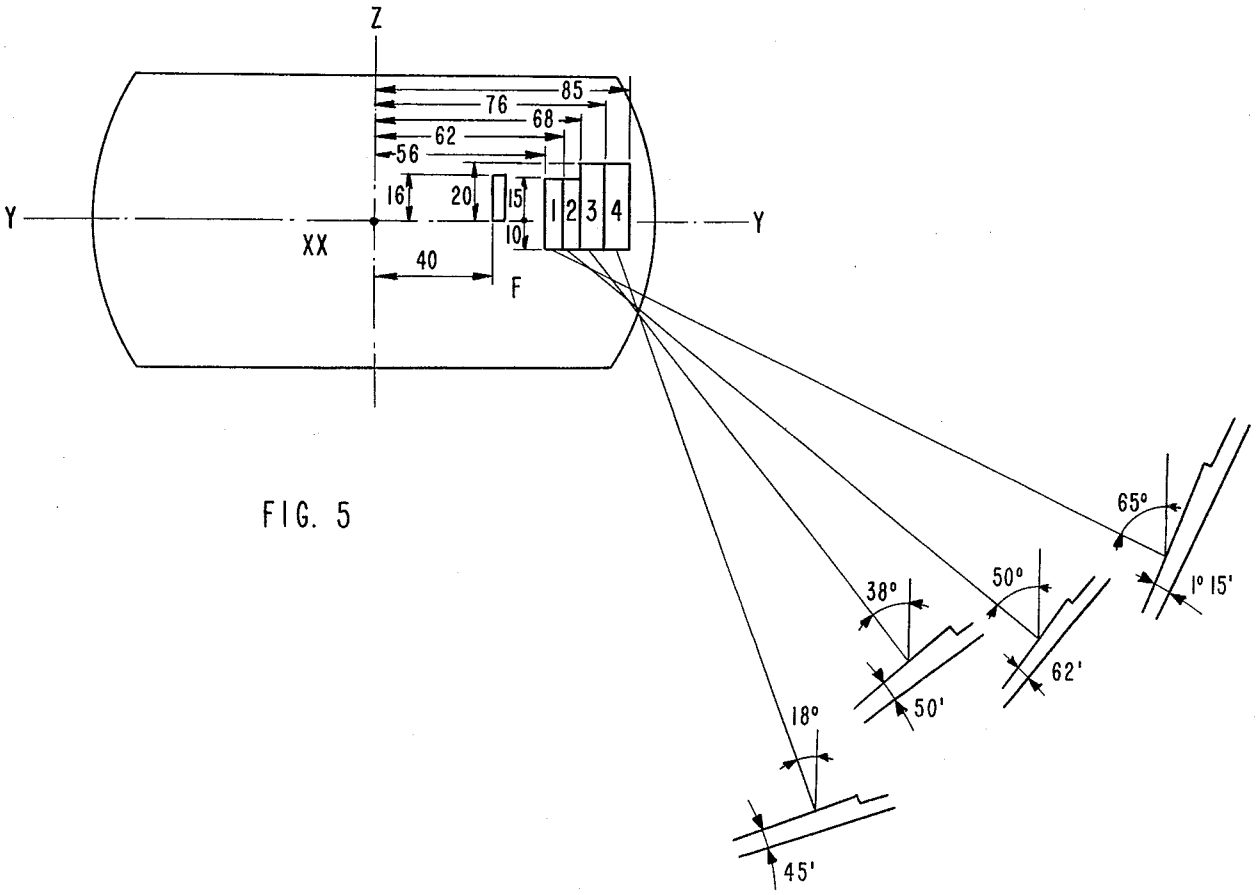

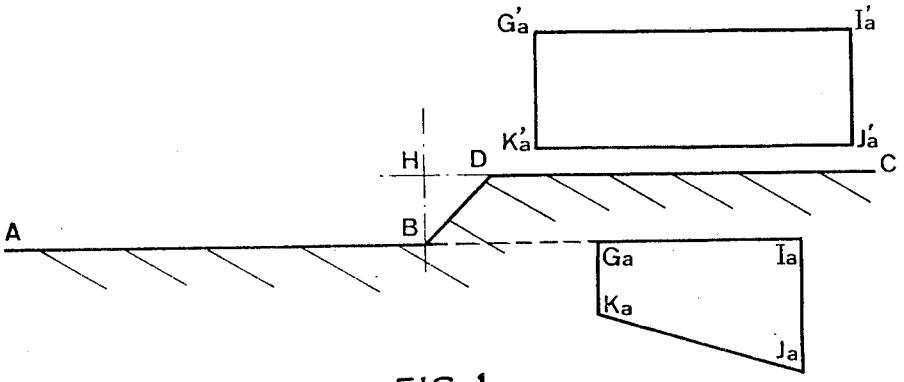
FIG. 1
FIG. 2
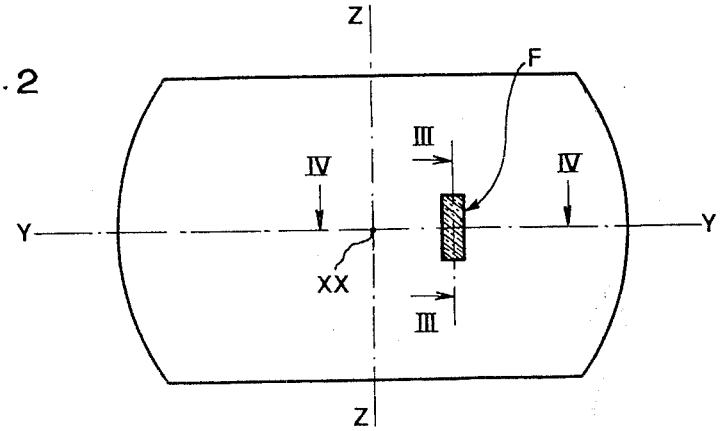
FIG. 3
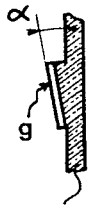
FIG. 4
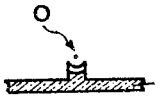

MOTOR VEHICLE HEADLAMPS

A motor vehicle headlamp was described in my prior U.S. Pat. No. 3 858 040 and British Pat. No. 1 347 357, for producing a dipped beam and comprising, in a characteristic combination, masking (or cut-out) means for producing the masking of the dipped light beam along two horizontal half-planes of cut-out substantially one in the extension of the other on either side of the central axis of the reflector and headlamp and a plurality of juxtaposed prismatic deflecting surfaces for causing the raising of the cut-out half-plane disposed on the side of the road on which the motor vehicle normally travels, such that the cut-out is finally produced along two horizontal half-planes of staggered height connected by an inclined oblique segment.

In the following, to simplify the explanation both of the invention and of the prior art, it will be assumed that traffic travels on the right-hand side of the road, without this choice being limiting for the construction of the headlamp, a transfer from one case to the other being within the scope of a man skilled in the art.

The mechanism for forming images used to produce the cut-out according to the prior Patent will be briefly recalled hereafter: given a dipped beam, such as reflected by the reflector, defined by two horizontal cut-out half planes one in the extension of the other (which are obtained for example for an axial light filament using a cup whose two lateral edges parallel to the axis of the reflector are at the same level), each prismatic surface associated with the front glass intersects a small part of the beam, directly below the right-hand half-plane of cut-out and the part of the beam thus intersected is projected onto a reference screen according to a quadrangular image. Each of the juxtaposed prismatic surfaces produces on the screen, by a similar mechanism, a quadrangular image and the left-hand upper corners of these various images are arranged such that they produce an approximation in steps of the desired inclined oblique segment. On the other hand, the prismatic surface producing the upper part of the oblique segment also produces the right-hand upper half-plane offset in the upwards direction, which is also desired. Generally, it is possible to make an image formed on a screen correspond to the contour of a window in the region of the glass, the contour of the image corresponding to the section through the screen of the elementary beam passing through the window. On the other hand, a dioptric system located on the window produces a displacement and deformation of the image. These notions must be memorised to understand the explanation of the present invention.

All the tests carried out by the Applicant have shown the attainable and effective character of the "Z masking" of the prior patent.

It even appears that the means of the prior patent could be considered as too effective since, above the raised right-hand plane of cut-out (bearing the reference DC in the prior patent), the lack of light is sometimes too marked. The result is that the driver of a vehicle provided with headlamps according to the prior patent may experience, when driving with dipped beam, difficulties in distinguishing objects located on the right-hand side of the road and at a certain height in particular traffic signs.

In certain cases, it thus seems opportune to complete the arrangements of the prior patent in order to increase the light intensity above the right-hand half-plane of cut-out.

The present invention proposes to solve this problem by selectively adding to the deflecting surfaces of the prior patent, an auxiliary dioptric system for providing an additional light flux above the right-hand half-plane of cut-out.

The following description and the accompanying drawings will make it easier to understand how the present invention may be carried into practice. Apart from indications to the contrary, the references used in the prior patent will be used in the following, to which references it may be advisable to refer for a more complete understanding of the present description. In the accompanying drawings:

FIG. 1 is an illustration on a screen of cut-out produced according to the prior patent incorporating the improvement of the present invention, FIG. 2 is a diagrammatic front view of a headlamp improved according to the present invention, FIG. 3 is a vertical section on line III—III of FIG. 2, FIG. 4 is a section on line IV—IV of FIG. 2, FIG. 5 is a front view of a headlamp having an axial filament, identical to that of FIG. 4 of the prior patent and in which the complementary arrangements of the invention have been incorporated.

FIG. 1, similar to FIG. 1 of the prior patent, shows the Z cut-out line, ABDC, produced according to the prior patent such as it appears on a reference screen. The problem is now to illuminate a region located above the part DC. According to the present invention, to modify the dipped beam, an auxiliary window F is used on the front glass, which window corresponds on the screen to the image G*a* I*a* J*a* K*a* and there is placed on this window, preferably in the region of the glass, a dioptric system such that the image on the screen instead of forming at G*a* I*a* J*a* K*a*, in fact forms at G'*a* I'*a* J'*a* K'*a* according to the mechanism for displacement and deformation of the image described in the prior patent.

It is quite easy to define the intensity of light inside the window as well as its position, in order that traffic signs are perfectly visible and this is without hindering on-coming vehicles or vehicles in front; in the following, the regulations of the E.E.C. (European Economic Community) will be referred to as regards the norms to be observed.

An intensity of 300 or 400 candles remains compatible, except at the point B50, with the tolerances of the E.E.C. regulations with regard to dazzling and gives appreciable assistance in reading traffic signs.

The region G'*a* I'*a* J'*a* K'*a* is not intended to illuminate either B50 or the point HV, nor the immediate upper vicinity of the cut-out line since, in these regions, parasite illumination is generally sufficient and cannot be increased by the limits imposed by the regulations.

If the co-ordinates of the points G'*a* I'*a* J'*a* K'*a* are defined by the angle formed, from the centre of the headlamp glass, by the directions of the points G'*a* I'*a* K'*a* J'*a* with the direction of the point H-reference axis, assume to be horizontal — it is possible to retain the following values:

Region G'*a* I'*a* K'*a* J'*a*, owing to the presence of on-coming vehicles on the left-hand side of the point H and of the existence of the point B50 in the regulation, is placed to the right of the point H, at a sufficient distance from this point H so as not to add parasite light. An angle of 1° or 2° is chosen between the direction of the segment G'a K'a and the vertical plane passing through H.

The space between the direction of K'a J'a and the horizontal plane passing through H is slight so as not to create too great a discontinuity of light between DC and K'a J'a. This may be 20' to 30' for example, but it is preferable that the range of illumination of the edge DC and the range of illumination of the edge K'a J'a merge at a level of 300 to 400 candles so that there is no discontinuity of light and the standards relating to dazzling are not exceeded.

Since traffic signs are not more than 3° above the horizontal, the G'a I'a limit is close to this value so as not to cause a troublesome halo in mist.

On the right-hand side, the I'a J'a limit is at approximately 8°from the vertical passing through H so as not to waste light in a region where subjects of interest are rare.

A man skilled in the art will certainly have no difficulty in ascertaining the characteristics of the windows and dioptric systems to be used in all cases, on the basis of the above indication.

However, with reference to FIGS. 2, 3 and 4, there will now be described the realisation of an auxiliary dioptric system according to the present invention on the front glass of a headlamp according to the first embodiment of the prior patent (headlamp having an axial filament).

As regards the light flux passing through the window F constituting the contour of the auxiliary dioptric system, it is necessary to choose a value of approximately two lumens (corresponding to 400 candles in a field of 6° × 3°). In the example of a headlamp having a halogen bulb, this flux value corresponds substantially to a window surface F of 50 mm².

In addition, the window F should be appropriately positioned on the glass. In order that the images passing through the window (contour Ga, Ia, Ja, Ka) are easy to move, in order to form an illumination on the screen according to the contour G'a I'a J'a K'a, the position for the window is chosen in the vicinity of the horizontal YY of the headlamp and of its mirror and sufficiently close to the central axis (X—X) in order that the dimension Ia Ja on the screen is virtually equal to I'a J'a and in order that the lateral movements of Ga Ka towards G'a K'a on the one hand and of Ia Ja towards I'a J'a on the other hand, are substantially equal.

To do this, there is placed on the window F of the glass, a dioptric system composed of a prism, giving a vertical deflection equal to the angular distance Ga Ia/G'a I'a combined with a ridge having a circular generatrix such that the right and left-hand deflections correspond to the angular distances Ga Ka/G'a K'a and Ia Ja/I'a J'a.

FIGS. 3 and 4 illustrate the shape of the dioptric system: the vertical section of FIG. 3 shows the prism of angle $\alpha$. The horizontal section of FIG. 4 shows the part rounded according to a radius $r$ about an axis $o$. The dioptric surface thus defined is a cylinder having a circular directrix having an oblique generatrix $g$.

FIG. 5 shows very precisely the implantation of the window on the glass of a headlamp which is absolutely identical to that of FIGS. 4, 5 and 6 of the prior patent. In this case, the window F is located at a distance of 40 mm from the axis of the mirror (FIG. 5 of the prior patent shows that a distance from the edge of the image Ga Ka to the axis H of approximately 1°30' or 2.5 hundredths of a radian corresponds to an opening radius of 40 mm). Thus a prism is chosen having an angle $\alpha$ equal to approximately 5°, deflecting laterally through 30' to bring the edge of the image G'a K'a to 1° of lateral divergence from the vertical axis of the headlamp. On the other hand, a width of the ridges (on the Y—Y axis) of 3 mm is chosen, associated, as aforementioned, with a radius $r$ of 10 mm. Finally, a window F having a height of 16 mm is chosen.

Finally, one obtains a window surface of 48mm² which corresponds to the desired flux and a means height (dimension I'a J'a) of the image of approximately 3° (naturally, like all the angular values of images given in the present invention, this relates to angles measured from the centre of the headlamp glass which is at a distance of 25 meters from the reference screen).

It will be noted that the trapezoidal shape of the image formed by the light rays passing through the window F is a favourable shape in the sense that the dispersion of the part of the flux located in the region of Ka Ja makes it possible to create a homogeneous range of illumination in the image region K'a J'a which is easily linked with the masking DC.

The figures shown in FIG. 5 correspond to values in mm. On the other hand, FIG. 5 also shows, as in the prior patent, the apertures of the prismatic surfaces 1, 2, 3, 4, as well as the angles of greater inclination with respect to the horizontal, as defined in the prior patent and which may also be defined as being the angles of the geometric edges of the prismatic surfaces with the vertical Z—Z.

What we claim is:

1. In a dipped headlamp for a motor vehicle of the type comprising a front glass, cut-out means producing masking of the dipped beam along two horizontal half-planes of cut-out on either side of the central axis and a plurality of juxtaposed prismatic deflecting surfaces associated with said front glass causing the raising of the half-plane of cut-out located on the side on which said vehicle normally travels and producing two horizontal half-planes of staggered height connected by an inclined oblique segment, the improvement comprising an auxiliary dioptric system adapted to intercept a portion of the flux passing through the glass and to raise it above the half-plane of cut-out located on the side of the road on which said vehicle normally travels in order to sufficiently illuminate traffic signs.

2. A headlamp according to claim 1, in which the auxiliary dioptric system is an integral part of the front glass and is arranged relatively close to the central axis.

3. A headlamp according to claim 1, in which the headlamp having an axial filament, the dioptric system is defined by a substantially rectangular contour whose major side is vertical, the dioptric system being composed of a vertical deflecting prism combined with a ridge having a circular generatrix for lateral deflection.

4. A headlamp according to claim 1, in which the lower limit of the auxiliary image produced by the auxiliary dioptric system is only slightly above the horizontal half-plane of cut-out on the side of the road on which said vehicle normally travels, such that this image is connected by a homogeneous range of illumination to the cut-out line at a level of 300 to 400 candles so that there is no discontinuity of light.

* * * * *